US010323461B2

(12) United States Patent
Hanns

(10) Patent No.: US 10,323,461 B2
(45) Date of Patent: Jun. 18, 2019

(54) TRI CONE DRILL BIT

(71) Applicant: David Hanns, New South Wales (AU)

(72) Inventor: David Hanns, New South Wales (AU)

( * ) Notice: Subject to any disclaimer, the term of this patent is extended or adjusted under 35 U.S.C. 154(b) by 12 days.

(21) Appl. No.: 14/894,182

(22) PCT Filed: May 27, 2014

(86) PCT No.: PCT/AU2014/050051

§ 371 (c)(1),
(2) Date: Nov. 25, 2015

(87) PCT Pub. No.: WO2014/190392

PCT Pub. Date: Dec. 4, 2014

(65) Prior Publication Data

US 2016/0123084 A1 May 5, 2016

(30) Foreign Application Priority Data

May 27, 2013 (AU) ..... 2013901881

(51) Int. Cl.
*E21B 10/18* (2006.01)
*E21B 10/08* (2006.01)

(52) U.S. Cl.
CPC ..... *E21B 10/08* (2013.01); *E21B 10/18* (2013.01)

(58) Field of Classification Search
CPC ..... E21B 10/08; E21B 10/18
See application file for complete search history.

(56) References Cited

U.S. PATENT DOCUMENTS 2,901,223 A * 8/1959 Scott ..... E21B 10/08 175/333
4,189,014 A 2/1980 Allen et al.
4,538,691 A * 9/1985 Dennis ..... E21B 10/04 175/393
5,562,171 A 10/1996 Besson et al.

FOREIGN PATENT DOCUMENTS

EP 0036772 9/1981
WO WO2009/091989 7/2009

* cited by examiner

*Primary Examiner* — Nicole Coy
*Assistant Examiner* — Jonathan Malikasim
(74) *Attorney, Agent, or Firm* — Skinner and Associates; Joel Skinner

(57) ABSTRACT

A drill bit including: a main body portion including three legs extending therefrom, the three legs arranged around a periphery of the main body portion; a conical cutter rotatably mounted on each leg, the conical cutters positioned to allow a clearance between the conical cutter and the main body portion; a protrusion extending from the main body portion into the clearance, wherein the protrusion encourages drill cuttings away from a base region of the main body portion where the legs meet the main body portion.

6 Claims, 4 Drawing Sheets

TRI CONE DRILL BIT

TECHNICAL FIELD

The present invention relates to a tri cone chill bit.

BACKGROUND

With reference to FIG. 1, a typical tri cone drill bit is shown which includes a main body portion with a generally cylindrical outer surface which includes a threaded portion (not shown) by which the drill bit is connected to the end of a drill string (not shown).

Extending from the main body 12 in an axial downward direction (although FIG. 1 shows the drill bit in the reversed orientation), are three legs equally spaced about a central longitudinal axis of the main body portion.

The three legs are connected to three conical cutter elements which are able to rotate relative to the legs which are fixed with respect to the main body portion. The conical cutting elements are typically provided with several rows of teeth.

Inspection of drill bits during operational life has consistently shown that the flow of air and fragmented material must take a specific path in order to exit from under and then around the bit.

The present invention seeks to provide a drill bit which facilitates the removal of fragmented material from under the drill bit and hence provide a drill bit which provides increased efficiency during the drilling operation.

SUMMARY

According to a first aspect, the present invention provides a drill bit including:

- a main body portion including three legs extending therefrom, the three legs arranged around a periphery of the main body portion;
- a conical cutter rotatably mounted on each leg, the conical cutters positioned to allow a clearance between the conical cutter and the main body portion;
- a protrusion extending from the main body portion into the clearance,
- wherein the protrusion encourages drill cuttings away from a base region of the main body portion where the legs meet the main body portion.

In one form, the protrusion forms an apex substantially equidistant to the three legs. In a further form the protrusion includes a sloping surface between the apex and a base region of the main body portion. In an additional form the sloping surface continues through the base region of the main body portion, emerging at an outer surface of the main body portion. In a still further form, the protrusion includes a plurality of sloping faces converging at the apex. In another form the sloping faces are convex, defining a ridge between the sloping faces.

In one form, the drill bit further includes one or more air outlets located on the base region of the main body portion and configured to direct air substantially toward the conical cutters. In another form, the one or more air outlets are elongated with a long axis in the direction radial to the longitudinal axis of the main body portion. In a further form, the air outlets are located at the periphery of the base region of the main body portion, between the region occupied by the legs. In a still further form, the legs and one or more air outlets are positioned within the ridges, the sloping face then forming channels for drill cuttings to flow therethrough, the channels originating from the apex, passing between the legs and one or more air outlets, and continuing through to the outside surface of the main body portion. According to a final form the air outlets are in the form of nozzles.

BRIEF DESCRIPTION OF THE ACCOMPANYING FIGURES

The present invention will become better understood from the following detailed description of various non-limiting embodiments thereof described in connection with the accompanying figures, wherein.

PARTS LIST

Figure 1:
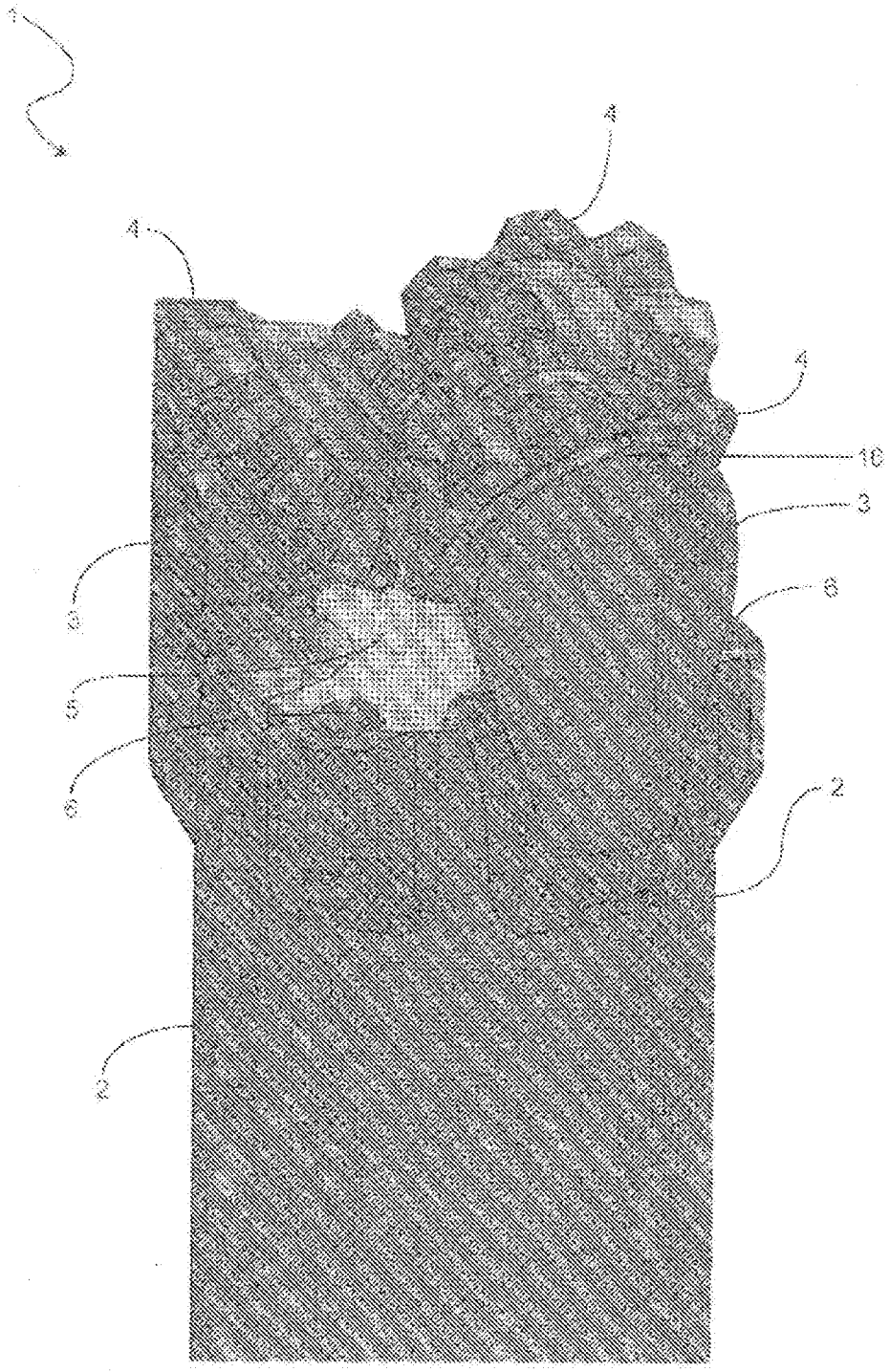
Figure 1 PRIOR ART
FIG. 1 is a view of a prior art tri cone drill bit tone drill bit.

1 Prior art drill bit
2 Main body portion of the drill bit
3 Legs
4 Cutting cones
5 Base region of main body portion
6 Air outlet
7 Drill bit according to present invention
8 protrusion
9 apex of protrusion
10 ridge
11 sloping face of protrusion
12 channel
13 outer surface of the main body portion
14 scallops
15 modified air outlet
16 Shirt tail
17 Bearings

DETAILED DESCRIPTION OF EMBODIMENTS AND THE ACCOMPANYING FIGURES

The foregoing describes only some embodiments of the present invention, and modifications and/or changes can be made thereto without departing from the scope and spirit of the invention, the embodiments being illustrative and not restrictive.

In the context of this specification, the word "comprising" means "including principally but not necessarily solely" or "having" or "including", and not "consisting only of". Variations of the word "comprising", such as "comprise" and "comprises" have correspondingly varied meanings.

A typical tri-cone drill bit is shown in FIG. 1. This drill bit 1 may be coupled with a drill string (not shown). The drill bit has a main body portion 2, from which three legs 3 extend in a direction substantially co-linear with the main body portion 2 and the attached drill string. The legs 3 are positioned at even intervals around the periphery of the drill bit, and are each adapted to mount a conical cutter 4. The conical cutters 4 are each configured to rotate around an axis of rotation. The conical cutters 4 will generally have teeth or an abrasive surface such that the three rotating cones form a drill face, cutting or grinding through material placed in contact thereof.

Material removed by the conical cutters 4, referred to as drill cuttings or cuttings, is substantially drawn towards a base region 5 of the main body portion 2, through the rotating action of the cutlers 4 and the advance of the drill bit into the hole being drilled. The base region 5 of the main body portion 2 is located in the general region where the legs 3 meet the main body portion 2.

Drill cuttings that are not drawn away from the base region 5 may accumulate in the hole being drilled an in the general vicinity of the drill bit. This accumulation of material can lead to the regrinding of the material, which lowers the productivity of drilling, and leads to additional abrasive wear of the drill bit. Removal of drill cuttings away from the conical cutters 4 and more generally, away from the base region 5, is critical to the drilling efficiency and operational life of the drill bit 1.

Referring still to FIG. 1, the drill bit 1 includes one or more air outlets 6. The air outlets are configured to blast high pressure air into the hole being drilled. This air dislodges and removes drill cuttings from in front of the drill face for reasons already described. The air outlets 6 are generally located at the periphery of the main body portion 2, between the legs 3. In certain embodiments, the air outlets 6 are located adjacent or substantially adjacent to the legs 3, whereas in the embodiment of FIG. 1, they are equidistant to the legs.

Inspection of tri cone drill bits during operational life has consistently shown that the flow of air and fragmented material must take a specific path in order to exit from under the cones 4 and away from the base region 5. Cuttings generated by the cones 4 fall are projected onto the base region 5 of the main body portion 2 as a hole is being chilled. Due to the flat characteristic of base region 5, drill cuttings will accumulate here and interfere with the flow of cuttings away from the hole. This results in significant turbulence of drill cuttings in the region of the drill bit 1, which causes disruption to the flow of particles trying to exit from under the drill bit and out of the hole.

In addition, the positioning of the air outlets 6 results in a portion of drill cuttings moving away from the base region 5 will become entrained in the air flow directed toward the hole. This entrainment will continually return a portion of the drill cuttings into the hole being drilled by the drill bit 1, instead of exiting away from the drill bit as intended. This phenomenon also adds to the turbulence in the flow of drill cuttings discussed in the paragraph above.

The present invention seeks to improve the removal rate of drill cuttings, both from the hole being drilled and from the drill bit in order to increase productivity of drilling and reduce abrasive wear on the drill bit.

Figure 2:
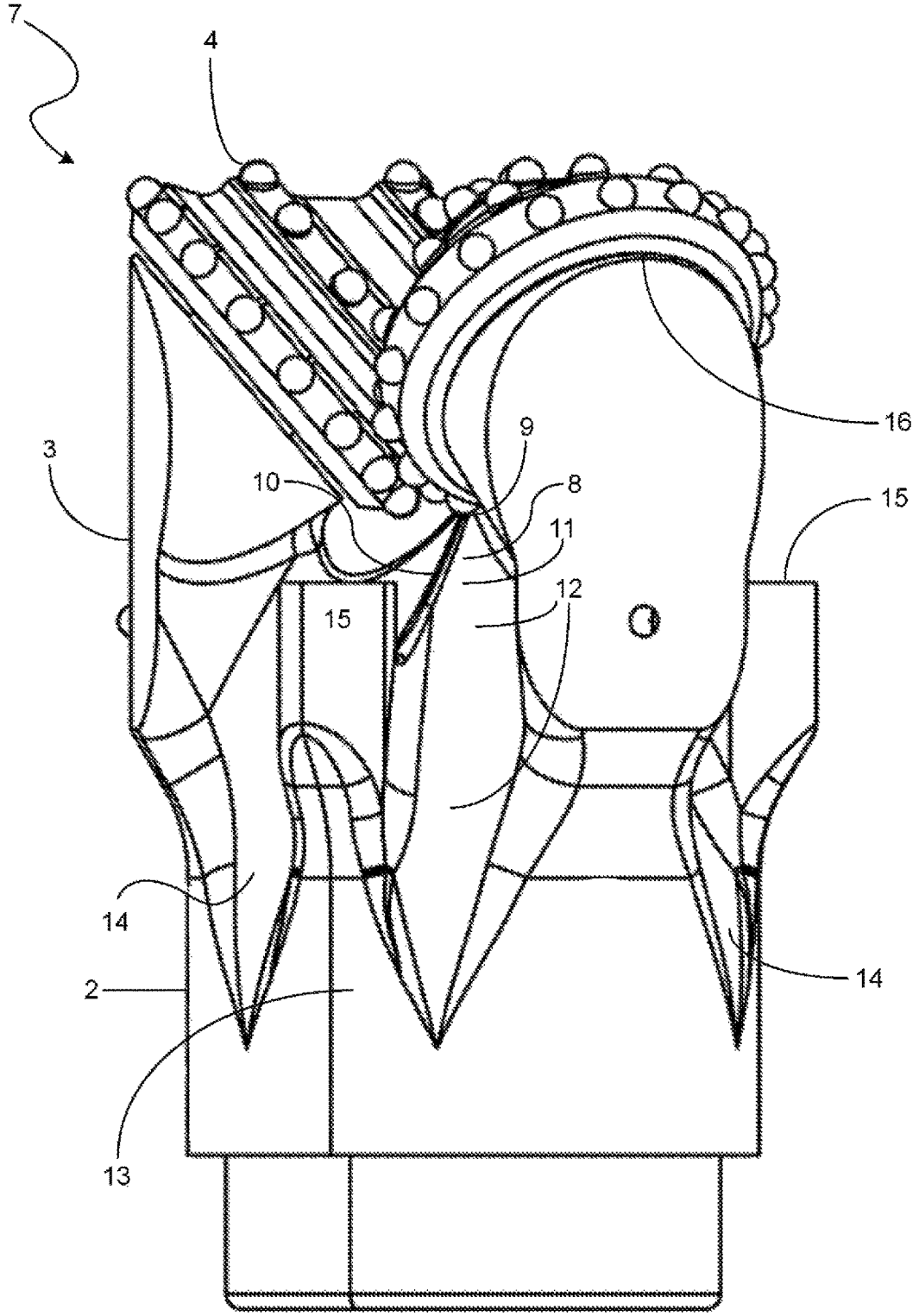
FIG. 2 is a view of a tri cone drill bit in accordance with the present invention.
Figure 3:
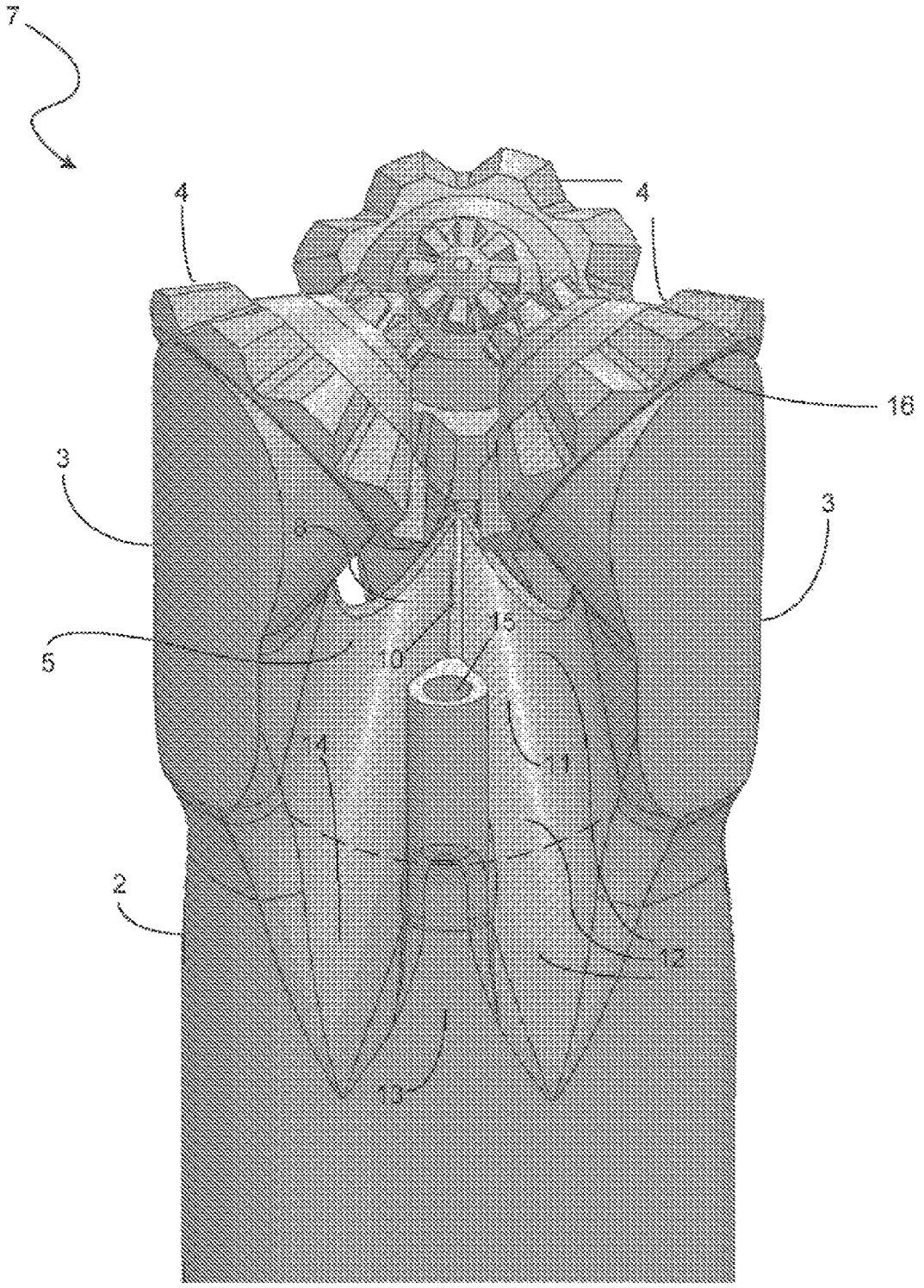
FIG. 3 is an alternate view of a tri cone bit in accordance with the present invention, shown in a rendered presentation.
Figure 4:
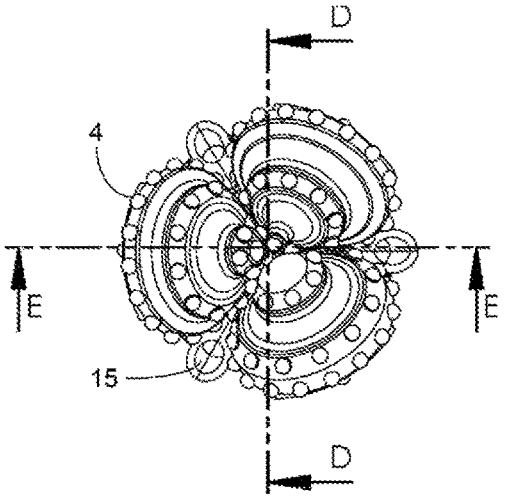
FIG. 4 is a plan view in accordance with the present invention.
Figure 5:
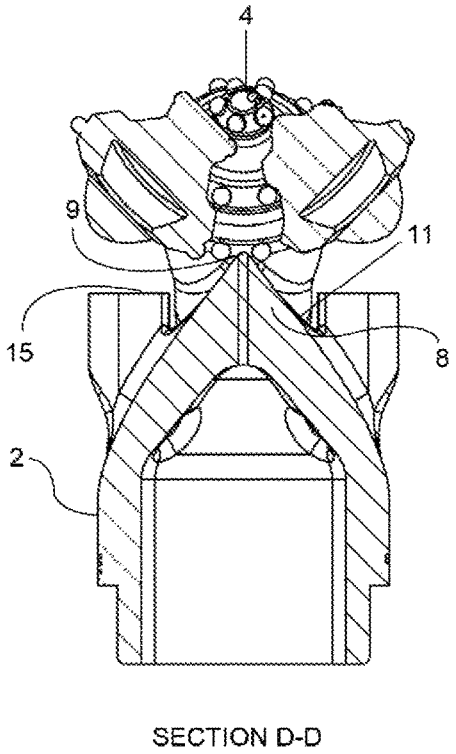
FIG. 5 is a section view in accordance with the present invention.
Figure 6:
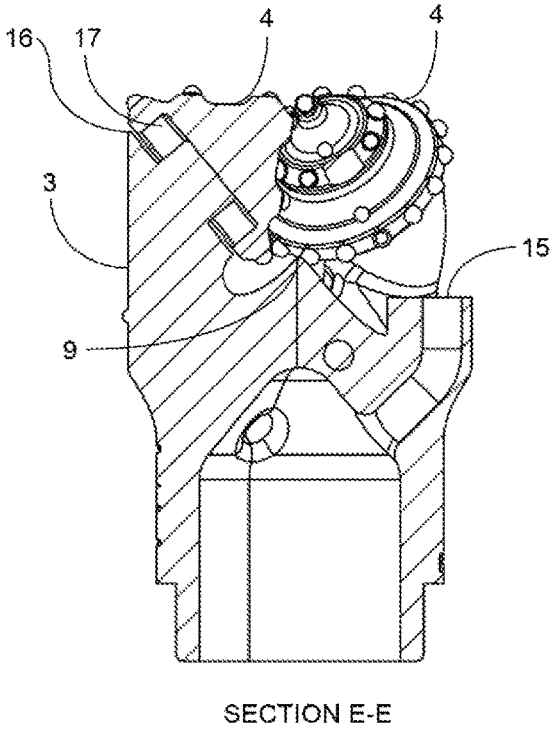
FIG. 6 is an alternate section view in accordance with the present invention.

FIG. 2 shows a certain embodiment of a tri cone drill bit 7 according to the present invention. In this embodiment the base region 5 is adapted to include a protrusion 8. This protrusion 8, is configured to extend from the base region 5 into the clearance, or space, between the base region 5 and the cutting cones 4.

According to certain embodiments, the protrusion 8 will converge substantially to an apex 9. In the embodiment of FIG. 2, this apex 9 is sharply defined, but in other embodiments, apex 9 may be blunt, or less defined. In the embodiment of FIG. 2, the protrusion 8 and the apex 9 are symmetrically arranged on the base region 5 of the main body portion 2. Such a configuration includes the apex 9 being positioned substantially equidistant from each of the legs 3 and the cones 4. Also, in such a configuration, the apex 9 is centred underneath the meeting point of the three cones 4.

As a portion of the drill cuttings are conveyed towards the base region 5 of the main body portion 2 by the rotation of the cones 4 and the advance of the drill bit into the hole being drilled, the cuttings will fall incident on the protrusion 8 rather than the flat base region 5 of the prior art drill bit 1 of FIG. 1. Cuttings incident on the protrusion 8 are guided by the sloping face of the protrusion 11 towards the periphery of the base region 5 of the main body portion 2. The effect of the protrusion 8 is to prevent accumulation and turbulence of cuttings in the region of the drill bit. This results in an increase in the speed by which cuttings are moved away from the drill bit 7 and the hole being drilled, reducing the regrinding of the cuttings, which in turn leads to greater drilling productivity and reduced abrasive wear on the drill bit.

The protrusion 8 of the drill bit 7 is also advantageous when drilling in soft boggy ground. As is the case with particulate cuttings, the protrusion 8 guides the soft ground and cuttings away from the base region 5 more efficiently than the flat base region of the prior art drill bit 1. This will decrease instances, of the drill bit becoming plugged by soft material, which can lead to the drill bit becoming bogged in the hole. The bogging of a drill bit is a major problem which can lake extensive down time to rectify and can ultimately lead to early bit failure.

The protrusion 8 of the embodiment showing in FIG. 2 is formed from a plurality of sloping faces converging at the apex 9. In the non-limiting embodiment shown, each sloping face is concave, resulting in ridges 10 being formed between adjacent sloping faces 11. In other embodiments, the protrusion and/or faces thereof can take any shape desirable. Examples of protrusions listed herein are not exhaustive, but are simply intended to illustrate potential forms. The protrusion can take any shape desired, with different shapes potentially offering different advantages in drilling speed, machining cost and wear profiles for different drill mediums, for example. One such example form is a protrusion, without a plurality of faces, such as a smooth mound or dome. Such a protrusion could be have either a concave or convex profile, depending on the application of the drill. Alternatively, the protrusion could have a combination of a concave and convex portion, such as protrusion with the shape of a three dimensional Gaussian curve. The protrusion could also have flat faces, similar to a pyramid with as many faces as desired for the application. Conical protrusions, with or without a sharp apex, may also be desirable in some drilling applications.

Different angles for the sloping face of the protrusion 11 may also find benefit for different applications. For example, when drilling hard ground, it may be advantageous to use a shallow angle, allowing the legs 3 to be larger and hence stronger. In applications such as this, the amount of steel used internally in the bit could also be increased to impart additional strength.

Returning to the embodiment of FIG. 2, the ridges 10 have been arranged in such a manner as to define clear channels 12. These channels offer a path for cuttings to pass unobstructed past obstacles such as the legs 3 and air outlets 15. This effect is further enhanced by smoothly moulding the legs 3 and air outlets 15 into the ridges 10.

According to the embodiment of FIG. 2, it is possible to continue the sloping face 11 of the protrusion 8 through the base region of the main body portion 2, emerging at an outer surface 13 of the main body portion. This effectively produces scallops 14 in the outside surface of the main body portion allowing the channels 12 to continue with a steeper gradient than would otherwise be possible.

The reduction in regrinding due to the present invention may also reduce abrasive wear to the shirt tails 16 of the bit 7. These shirt tails 16 protect the bearings 17 of the rotating cones. When sealed bearings are used, excessive shirt tail 16 wear causes the bearings 17 to become exposed and leak lubricating fluid, leading to drill failure. As sealed bearings are generally preferred to normal air bearings in mining and oil field applications, the present invention may lead to productivity gains in these industries.

The quick removal of drill cuttings and other debris from the hole being drilled is a key factor in drill productivity. Referring once more to FIG. 1, in typical tri cone bits, the exit point of the air outlet 6 are positioned between legs 3 at a distance substantially equidistant to each leg. This arrangement results in the air outlet occupying approximately ⅓ of the space available between the legs. Consequently, approximately ⅓ of the drill cuttings attempting to exit from the base region 5 of the main body portion 2, may become entrained in the high pressure air emanating from the air outlet 6. A portion of this entrained material will be re-blasted into the hole being drilled instead of being removed, leading to the regrinding of cuttings.

According to an embodiment of the present invention, the air outlets 15 can be shaped to occupy a smaller portion of the path available to drill cuttings to flow away from the drill bit. In a particular non-limiting embodiment, the air outlet can elongated 15 with a long axis orientated in a direction substantially radial to the longitudinal axis of the main body portion. In another non-limiting form, the air outlet 15 can be positioned closer to the legs 3 of the drill bit 7. Such an arrangement reduces the resistance to drill cuttings exiting the base region of the drill bit, and reduces the regrinding of material returned to the drill hole by entrainment in blast air.

In the embodiment of FIG. 2, the elongated air outlet 15 is positioned within a ridge 10 of the protrusion 8. Otherwise stated, the air outlet 15 is positioned outside of a channel 12, formed for the conveyance of drill, cuttings and debris away from the drill bit 7. This arrangement completely removes the air outlet 15 from the path of cuttings flowing away from the drill bit 7 by way of the channel 12.

The air outlet in the present invention may be a simple aperture, as represented in FIG. 2, or a nozzle, is desired for the drilling application.

The invention claimed is:

1. A drill bit including:

a main body portion including three legs extending therefrom, the plurality of legs arranged around a periphery of the main body portion, the main body portion comprising of a cylindrical outside surface and a central, internal, longitudinal bore;

a conical cutter rotatably mounted on each leg, the conical cutters positioned to allow a clearance between the conical cutter and the main body portion;

one or more air outlets located at a base region of the main body portion, each air outlet located between the region occupied by the legs and configured to direct air substantially toward the conical cutters, the one or more air outlets extending from the conical cutters in a radially outward direction;

a protrusion extending from the main body portion into the clearance wherein the protrusion includes a sloping surface including a plurality of sloping faces; the sloping surface continuing through the base region of the main body portion, emerging at an outer surface of the main body portion, the protrusion forming an apex disposed substantially equidistant to the three legs;

characterised in that there are a plurality of ridges between adjacent sloping faces, wherein at least a portion of the sloping faces are concave in cross-section, the concave sections defining the ridge between the portions of the concave sloping faces, at least one ridge of the plurality of ridges extending from the apex to one of the plurality of legs, the legs and one or more air outlets being positioned within the ridges, the sloping faces defining at least one ridge between the portions of the concave sloping faces, each sloping face thereby forming a plurality of channels for drill cuttings to flow there through, the channels passing between the legs and one or more air outlets, and continuing through to the outside surface of the main body portion, the channels further forming scallops on the outer surface of the main body;

the protrusion thereby defining the plurality of channels to guide drill cuttings away from the base region of the main body portion past the legs, the plurality of channels being substantially free of obstructions and guiding drill cuttings past the legs and the air outlets.

2. The drill bit according to claim 1 wherein the sloping surface is between the apex and the base region of the main body portion.

3. The drill bit according to 2 wherein the sloping surface includes the plurality of sloping faces converging at the apex.

4. The drill bit according to claim 3 wherein the sloping faces are entirely concave in cross section.

5. The drill bit according to claim 1 wherein the main body portion has a longitudinal axis, and the one or more air outlets are elongated with a long axis in the direction radial to the longitudinal axis of the main body portion.

6. The drill bit according to claim 1 wherein the one or more air outlets are in the form of nozzles.

* * * * *